US006594905B2

(12) United States Patent
Fürst et al.

(10) Patent No.: US 6,594,905 B2
(45) Date of Patent: Jul. 22, 2003

(54) HAIR REMOVING APPARATUS

(75) Inventors: Stefan Fürst, Kronberg (DE); Werner Haczek, Idstein (DE); Andreas Peter, Kronberg (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/931,559

(22) Filed: Aug. 16, 2001

(65) Prior Publication Data

US 2002/0004986 A1 Jan. 17, 2002

Related U.S. Application Data

(63) Continuation of application No. PCT/EP99/08523, filed on Nov. 6, 1999.

(30) Foreign Application Priority Data

Feb. 19, 1999 (DE) ..... 199 07 025

(51) Int. Cl.[7] ..... B26B 19/38
(52) U.S. Cl. ..... 30/41
(58) Field of Search ..... 30/41, 41.5; 606/133; 132/221, 289, 290; 417/428, 391; 239/127, 126; 452/103

(56) References Cited

U.S. PATENT DOCUMENTS

| | | | | |
|---|---|---|---|---|
| 2,754,228 A | * | 7/1956 | Bede | 239/127 |
| 3,176,392 A | | 4/1965 | Gwinn | |
| 3,359,634 A | | 12/1967 | Beck | |
| 4,228,587 A | | 10/1980 | Bennett | |
| 5,133,130 A | | 7/1992 | Podolsky | |
| 5,168,628 A | | 12/1992 | Mock et al. | |
| 5,673,485 A | | 10/1997 | Hill | |
| 5,993,180 A | * | 11/1999 | Westerhof et al. | 417/571 |
| 6,131,288 A | | 10/2000 | Westerhof et al. | |

FOREIGN PATENT DOCUMENTS

| | | |
|---|---|---|
| DE | 94 90 268 | 11/1995 |
| FR | 2 613 975 | 10/1988 |
| WO | WO 98/08659 | 3/1998 |
| WO | WO 98/08660 | 3/1998 |
| WO | WO 98/08661 | 3/1998 |
| WO | WO 98/55274 | 12/1998 |

* cited by examiner

*Primary Examiner*—Douglas D. Watts
(74) *Attorney, Agent, or Firm*—Fish & Richardson PC

(57) ABSTRACT

The invention is directed to a hair removing apparatus as, for example, a dry shaving apparatus, a hair clipping machine, an epilation appliance, with a housing and a liquid conveying arrangement comprising a liquid container, a drivable pumping device with a pump inlet and a pump outlet, and a liquid dispensing device for wetting a human skin and/or hairs with liquid, wherein the liquid dispensing device is adapted to be coupled to the pump inlet by way of a first liquid conduit and to the liquid container by way of at least one second liquid conduit.

42 Claims, 7 Drawing Sheets

HAIR REMOVING APPARATUS

This is a continuation of PCT application serial no. PCT/EP99/08523, filed Nov. 6, 1999, which claims priority from German application serial number 19907025.3, filed Feb. 19, 1999, (pending).

BACKGROUND

This invention relates to a hair removing apparatus of the type indicated in the prior art portion of claim 1.

A hair removing apparatus of the type referred to in the foregoing is known from FR 2 613 975 A1. Arranged in the housing of the dry shaving apparatus is a liquid container from which liquid is drawn through a pumping device and conveyed under pressure to two spray devices arranged in spaced relation to each other in the shaving zone. When this liquid conveying arrangement is set in operation, the spray device dispenses the liquid provided, regardless of whether or not the shaving apparatus is in engagement with the skin.

It is an object of the present invention to improve in an apparatus of the type initially referred to the liquid conveying arrangement with respect to the dispensing of liquid.

SUMMARY OF THE INVENTION

According to the present invention, this object is accomplished in an apparatus of the type initially referred to by the features indicated in claim 1.

The present invention which finds application in the hair removing apparatus affords a plurality of advantages. One major advantage of the invention resides in that the liquid conveying arrangement provided ensures a position-independent withdrawal of liquid from the liquid container by the liquid dispensing device. The liquids to be stored and dispensed include shaving aids such as pre-shave or after-shave lotions and/or lubricants designed to improve the gliding motions of an outer cutter on the skin and/or lubricants designed to lubricate cooperating cutter elements with or without fragrances added.

In a particularly preferred embodiment of the invention, the pumping device is capable of drawing both air and liquid from the liquid dispensing device and conveying it into the liquid container, and the liquid is deliverable to the liquid dispensing device by the development of a delivery pressure in the liquid container. It is thereby ensured that a pressure is built up in the liquid container for feeding the liquid from the liquid container to the liquid dispensing device, and the pumping device returns to the liquid container the liquid which has not been dispensed from the liquid dispensing device to a user's skin to be treated. Provision is made in the liquid container for a pressure relief valve to control the liquid delivery pressure and hence the quantity supplied.

In a particularly advantageous embodiment of the invention, the liquid container includes at least two chambers. In a further aspect of this embodiment a first chamber is provided for receiving air and/or liquid returnable from the liquid dispensing device. In a still further aspect of this embodiment, the second chamber accommodates a storage material for holding the liquid. To ensure the return flow of liquid from the first chamber to the second chamber, at least one passageway is provided in the partition wall separating the first from the second chamber. The passageway is preferably of a slotted configuration.

A preferred embodiment of the invention is characterized in that a liquid conduit is routed through the passageway and a gap is formed between the liquid conduit and the partition wall. This arrangement ensures advantageously that the liquid drawn from the liquid dispensing device is able to flow through the first chamber into the second chamber for storage in the storage material provided therein, and that the air likewise drawn in by the pumping device by way of the liquid dispensing device is able to develop in the first chamber a pressure controlled by the pressure relief valve, which pressure subsequently operates to convey the stored liquid from the storage material via a second liquid conduit to the liquid dispensing device. For this purpose the second chamber is adapted to be coupled with the liquid dispensing device through a second liquid conduit.

According to an embodiment of the invention, the second liquid conduit is configured to project into the second chamber such an amount that the mouth of the conduit is arranged at a relatively small distance B to a wall of the liquid container. This arrangement ensures that the complete liquid shaving aid stored in the storage material can be withdrawn to be conveyed to the liquid dispensing device.

The second liquid conduit is preferably constructed as a riser.

In another embodiment of the invention, the pumping device is provided in the first liquid conduit leading from the liquid dispensing device to the liquid container. A particularly advantageous embodiment of the invention is characterized in that the pumping device is arranged in the liquid container and the pumping device is replaceable, together with the replaceable liquid container, for a new liquid container with pumping device. Hence the efficiency of the pumping device is designed only for the quantity of liquid to be dispensed from the liquid container. The quality requirements to be imposed on the pumping device are therefore extremely low and result accordingly in an extremely economical production of the pumping device and the liquid container.

In a further aspect of the invention a pumping element of the pumping device is adapted to be acted upon by an on-off type drive element of a drive mechanism of the hair removing apparatus. In an alternative embodiment of the invention the pumping element of the pumping device is also manually actuatable.

One embodiment of a liquid dispensing device is characterized in that the liquid dispensing device is formed of a container housing having one side open and a contact element partly protruding therefrom and adapted to dispense liquid. Preferably, the contact element is formed of an open-pore material. In a further aspect of this embodiment a rinsing chamber is provided in the liquid dispensing device. The rinsing chamber ensures in advantageous manner a supply of liquid to the open-pore material of the contact element as well as the withdrawal and hence the return of liquid supplied by way of the second liquid conduit back through the first liquid conduit and through the pumping device to the liquid container.

An advantageous embodiment of the invention is characterized in that provision is made for at least one liquid dispensing device on the housing. An alternative embodiment of the invention is characterized in that the liquid dispensing device is provided on a long hair cutter unit. Preferably this long hair cutter unit can be arranged in a floating configuration.

In a particularly advantageous embodiment of the invention provision is made for at least one liquid dispensing device on a removable frame. Preferably the frame is constructed as a shaving head frame. In another embodiment the frame is constructed as a cutter frame. The liquid dispensing device may be secured either fixedly or detachably on the housing or on the long hair cutter unit or on the removable frame.

In a further aspect of the invention the liquid container is arranged for replacement in or on the hair removing apparatus. In another aspect of this embodiment the liquid container is fixedly arranged in or on the housing. In an alternative embodiment the liquid container is arranged in or on the housing so as to be adjustable by a distance A.

In one embodiment of the invention the liquid container is equipped with a filling valve.

According to a preferred embodiment of the invention the liquid container with the pumping device is arranged to be adjustable by a distance A. A significant advantage of this embodiment resides in that the adjustability of the liquid container and the pumping device enables the pumping device to be disconnected from, and connected to, an electric drive mechanism of the hair removing apparatus. It is thereby ensured that the user is able to decide about the use and the duration of use of the liquid dispensing device. In one embodiment of the invention the liquid container with the pumping device is adapted to be coupled to the electric motor. In a further aspect of this embodiment the pumping device is adapted to be coupled to the electric motor via oscillating members.

One embodiment of the present invention is illustrated in the accompanying drawings and will be described in more detail in the following.

In the drawings,

DETAILED DESCRIPTION OF DRAWINGS

Figure 1:
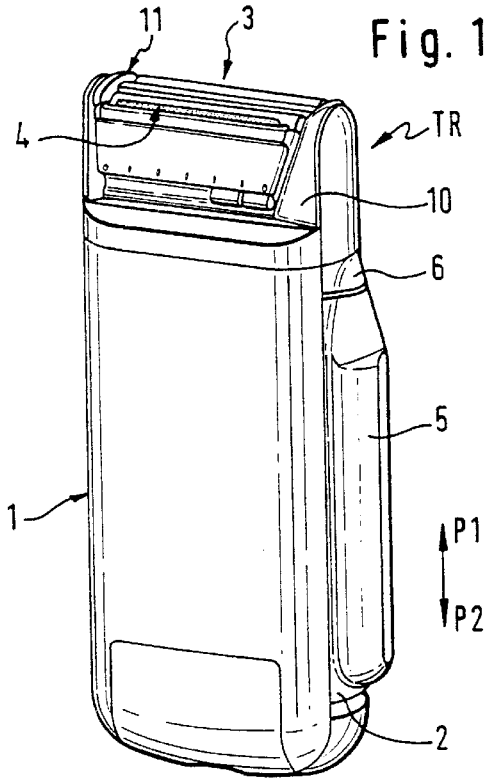
FIG. 1 is a perspective view of a dry shaving apparatus, showing the rear of the apparatus and a liquid container attached to a narrow side.

FIG. 1 shows a perspective representation of a dry shaving apparatus TR with a view of the rear of the housing 1 and of one of the two narrow sides 2 of the housing 1, and of the shaving head 3 on which a liquid dispensing device 4 is provided. A liquid container 5 is adjustably arranged on the narrow side 2 of the housing 1. In FIG. 1 the liquid container 5 is in abutment with a stop 6 provided on the housing 1. This liquid container 5 may also be disposed inside the housing 1—not illustrated.

Figure 2:
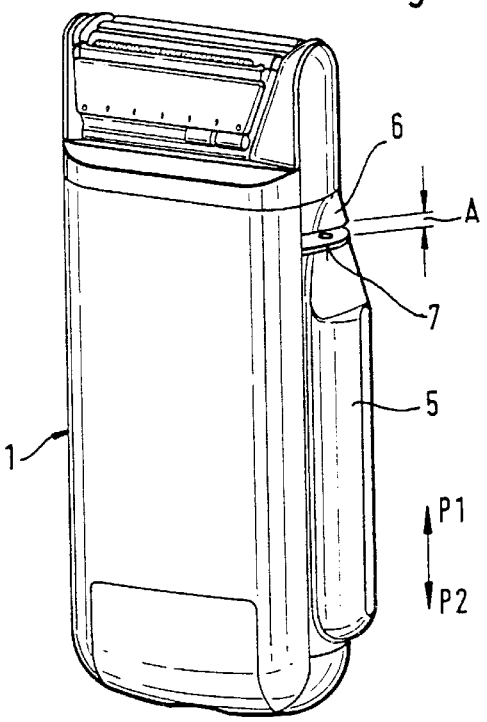
FIG. 2 is a view of the dry shaving apparatus of FIG. 1, showing a liquid container spaced from a stop by a distance A.

FIG. 2 shows the dry shaving apparatus of FIG. 1, the difference being that a distance A is produced between the upper wall 7 of the liquid container 5 and the stop 6 by sliding the liquid container 5 in the direction of the arrow P2. Sliding the liquid container 5 in the directions of the arrows P1 or P2 results in either the coupling or uncoupling of a pumping device 13 adapted to be driven by an electric drive 50 of the dry shaving apparatus—see FIG. 9.

Figure 3:
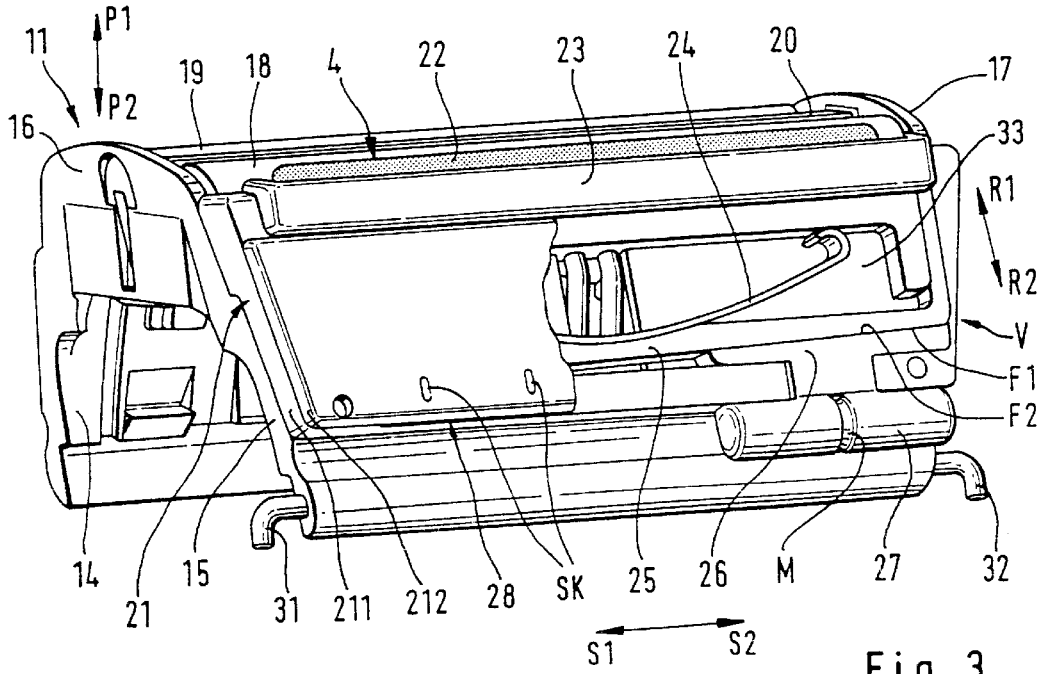
FIG. 3 is a view of a cutter frame with a housing whose outer housing part is shown only in part to expose the interior of the housing.

The shaving head 3 has at least one outer cutter and one undercutter cooperating therewith, as well as a shaving head frame 10 and a cutter frame 11 configured to be removed therefrom. One embodiment of such a cutter frame 11 is presented in FIGS. 3, 4 and 5 and will be explained in more detail in the following.

Figure 4:
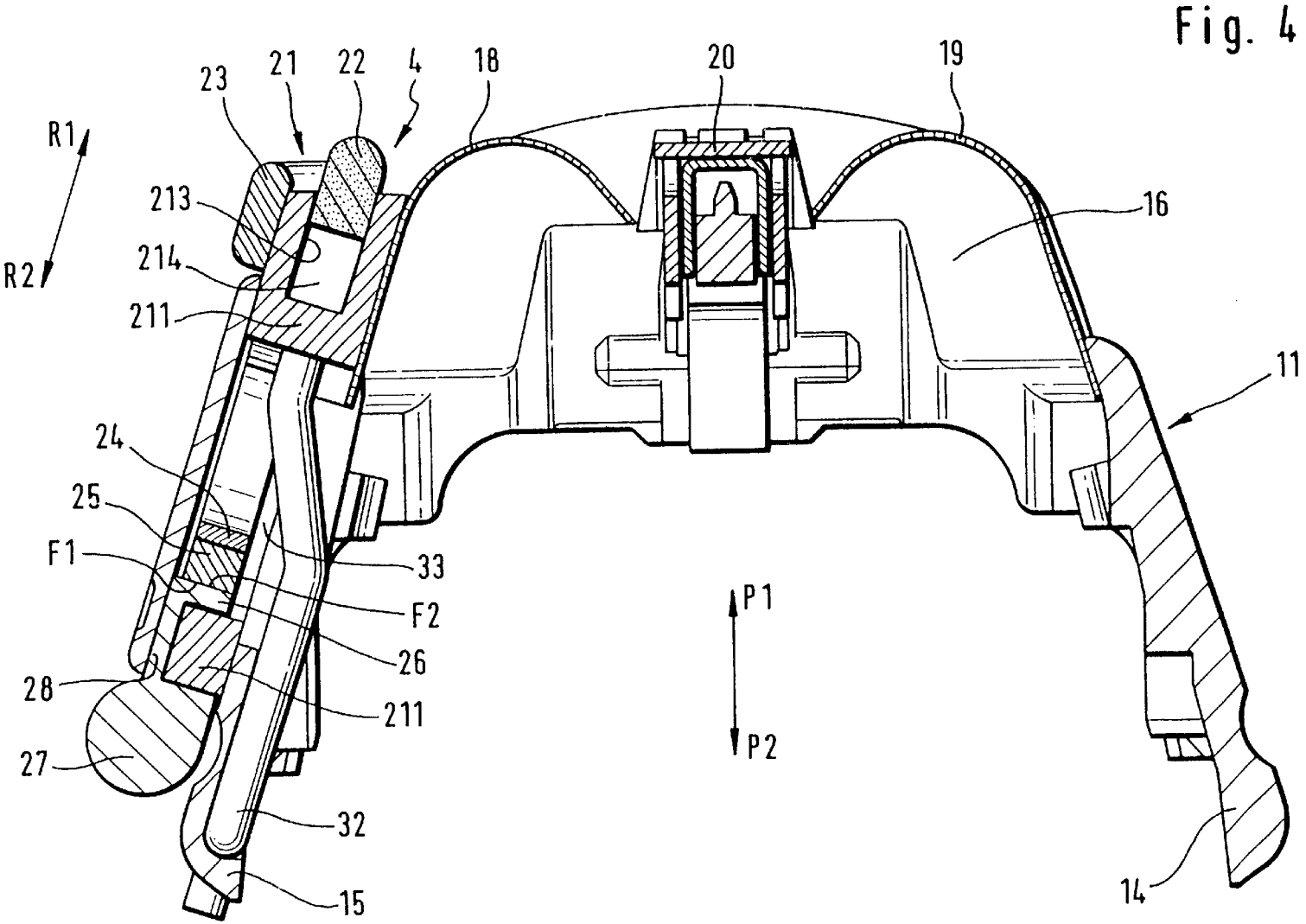
FIG. 4 is a sectional view of the cutter frame 11 and the liquid dispensing device.
Figure 5:
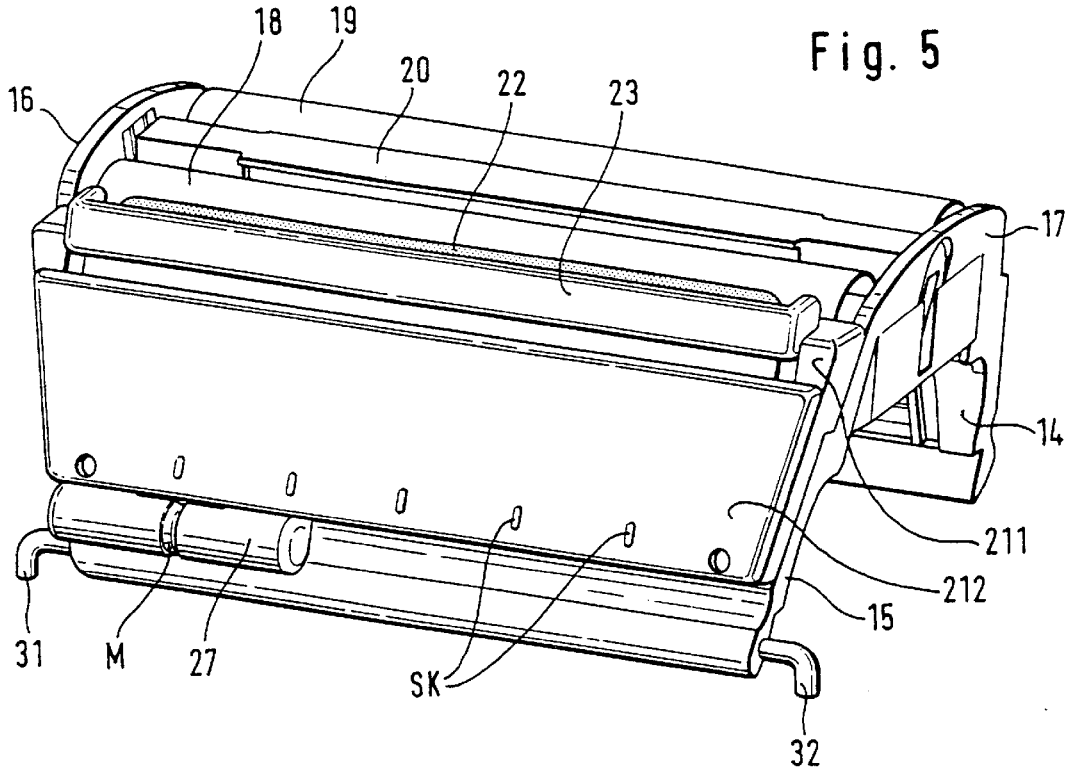
FIGS. 5 and 6 are perspective views of the cutter frame with a liquid dispensing device and an actuating element occupying different positions.
Figure 6:
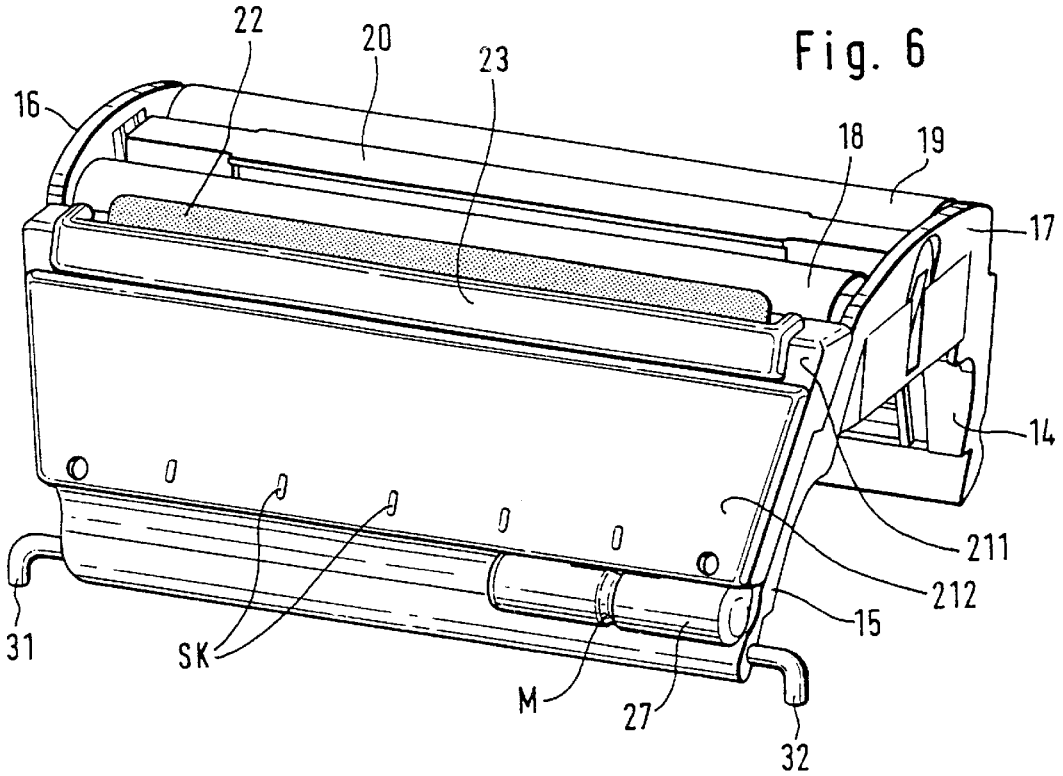

Inside the cutter frame 11—see also FIG. 4, FIG. 5 and FIG. 6—the outer cutters 18, 19, attached in arched form, of the short-hair cutter units are secured to longitudinally extending side walls 14 and 15 as well as to bars—not shown—disposed between end walls 16 and 17. The long-hair cutter unit with a U-shaped outer cutter 20 disposed between the two outer cutters 18 and 19 of the short-hair cutter units is mounted in the end walls 16 and 17 of the cutter frame 11 so that it can move in vertical direction—in the directions of the arrows P1 and P2.

A liquid dispensing device 4 is provided on one side wall 15 of the cutter frame 11. The liquid dispensing device 4 is essentially comprised of a housing 21 made up of two housing parts 211 and 212, an open-pore contact element 22 disposed in the housing 21, a spacer 23 associated with the contact element 22, and an adjusting device V by means of which the spacer 23 can be moved to and fro in the directions of the arrows R1 and R2. The adjusting device V is comprised of two cooperating adjusting elements 25 and 26 having surfaces F1 and F2 arranged at a relative inclination, a spring element 24, and an actuating element 27. Movably arranged in an inner compartment 33 of the housing part 211 of the housing 21 are the adjusting element 26 fitted with the actuating element 27, and the adjusting element 25 provided on the spacer 23. The spring element 24 rests with one part against a wall of the inner compartment of the housing part 211 and with another part against the adjusting element 25, its predetermined spring pressure operating to maintain the inclined surface F1 in abutment with the inclined surface F2 of the adjusting element 26. The housing part 212 of the housing 21 is fastened to the housing part 211, acting as a cover for the inner compartment 33 of the housing part 211.

The actuating element 27 with a marking M is provided on the adjusting element 26, which is slidably mounted inside the housing 21 and projects out of the housing 21 through an elongate opening 28. The actuating element 27 with the marking M is slidable parallel to a scale SK provided on an outer wall of the housing part 212. When the actuating element 27 is moved in the direction of the arrow S1, the inclined surface F2 of the adjusting element 26 cooperates with the inclined surface F1 of the adjusting element 25 to move the spacer 23 in the direction of the arrow R1. The spacer 23 is returned to its initial position—in the direction of the arrow R2—by sliding the actuating element 27 in the opposite direction—direction of the arrow S2.

The open-pore contact element 22, which is equipped with a rinsing chamber 214, is fixedly arranged in an inner compartment 213 of the housing part 211. The housing part 211 is arranged adjacent and parallel to the longitudinal dimension of the outer cutter 18 in such a way that the contact element 22, which is arranged in the inner compartment 213 and partly projects out of the inner compartment 213, is in a position to dispense liquid to a zone adjacent to the outer cutter 18. The contact surface of the contact element 22 used at any one time is variable and the liquid dispensing rate thus controllable by adjusting the spacer 23 relative to the contact element 22—see FIGS. 5 and 6.

The liquid to be dispensed by the contact element 22 of the liquid dispensing device is fed to the contact element 22 via a second liquid conduit 32. Metered application of the liquid by the contact element 22 is also controllable by drawing liquid from the liquid dispensing device 4 via a first liquid conduit 31.

Figure 7:
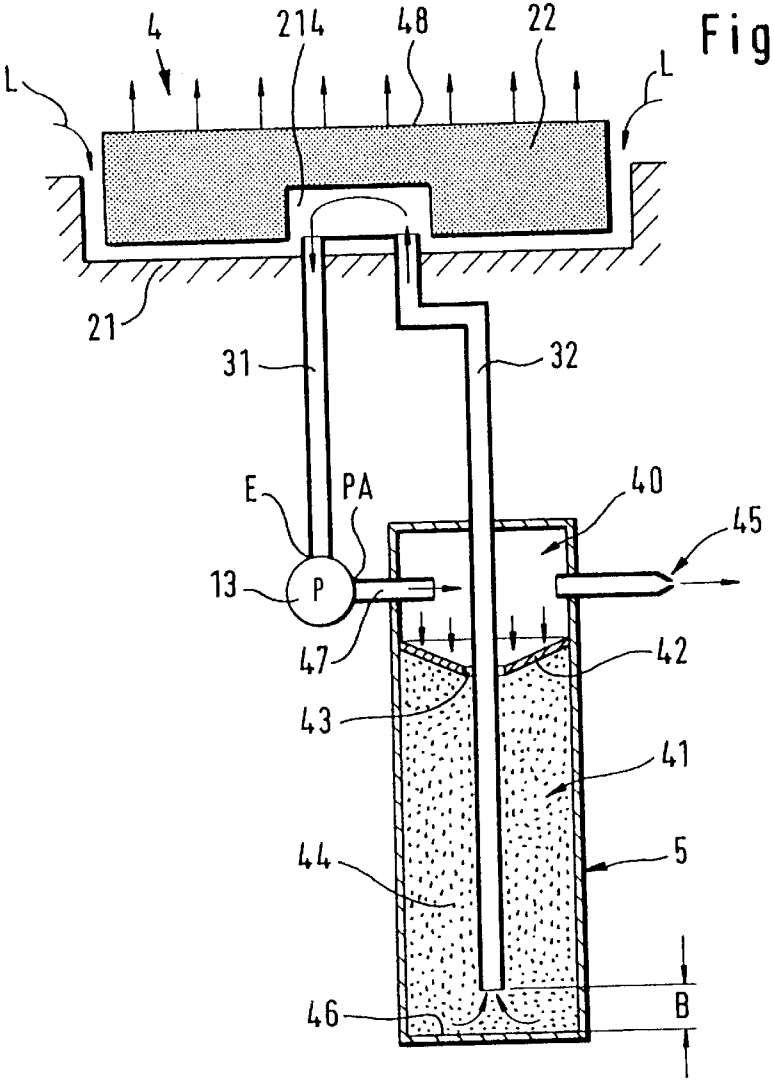

FIG. 7 shows a schematic representation of an arrangement for conveying liquid from the liquid container 5 to the liquid dispensing device 4 and from the liquid dispensing device 4 back into the liquid container 5. A partition wall 42 is provided in the liquid container 5 to form a first chamber 40 and a second chamber 41. An opening is provided in the partition wall 42. A second liquid conduit 32 is passed through this opening and terminates at a predetermined distance B from the bottom 46 of the liquid container 5. The opening in the partition wall 42 is dimensioned so that a gap 43 is formed after the second liquid conduit 32 is passed through. This gap serves the function of feeding liquid from the first chamber 40 into the second chamber 41. A porous storage material 44—e.g., a sintered material—is provided in the second chamber 41 to store the liquid. The first chamber 40 is connected by a liquid conduit 47 to a pumping device 13 provided outside the liquid container 5. The necessary pressure for conveying liquid from the second chamber 41 via the second liquid conduit 32, which acts as a riser, to the liquid dispensing device 4 is obtainable by means of a pressure relief valve 45 when the liquid conveying arrangement is working. The pressure relief valve 45 may be comprised of a tube, for example, having an orifice whose cross section is dimensioned to enable the necessary atmospheric pressure for conveying the liquid to be reached after the pumping device 13 is started and to enable any excess pressure to be discharged.

A contact element 22 is fixedly arranged in the housing 21 of the liquid dispensing device 4. By suitably shaping the contact element 22 a rinsing chamber 214 is provided in the contact element 22 which receives liquid via the second liquid conduit 32. The liquid under pressure penetrates the open-pore material of the contact element 22 and, when the outer contact surface 48 is touched by the skin, is dispensed onto the skin as indicated by the arrows.

The rinsing chamber 214 is coupled by a first liquid conduit 31 to the inlet side E of the pumping device 13. The outlet side PA of the pumping device 13 is coupled by a liquid conduit 47 to the first chamber 40 of the liquid container 5. When the pumping device 13 is set in operation it draws in air via the housing 21—see the arrow L—as well as liquid from the rinsing chamber 214 and/or the contact element 22, feeding it to the first chamber 40 to build up there the necessary pressure for conveying liquid from the second chamber 41 via the second liquid conduit 32 to the rinsing chamber 214. By returning any surplus liquid from the rinsing chamber 214 and/or the contact element, which results from the suction cycle of the pumping device 13, it is possible to control the dispensing of liquid by the contact element 22 in such a way that liquid is dispensed to a skin to be wetted only when the contact surface of the contact element 22 is touched. Hence no liquid is dispensed when the contact element 22 is not being touched.

The gap 43 between the partition wall 42 and the second liquid conduit 32, which acts as a riser, is dimensioned so that the liquid delivered by the pumping device 13 into the first chamber 40 can penetrate the storage material 44 in the second chamber 41. Any reverse flow of liquid stored in the storage material from the second chamber 41 through the gap 43 into the first chamber 40 is prevented by the bonding effect of the liquid to the storage material 44.

Figure 8:
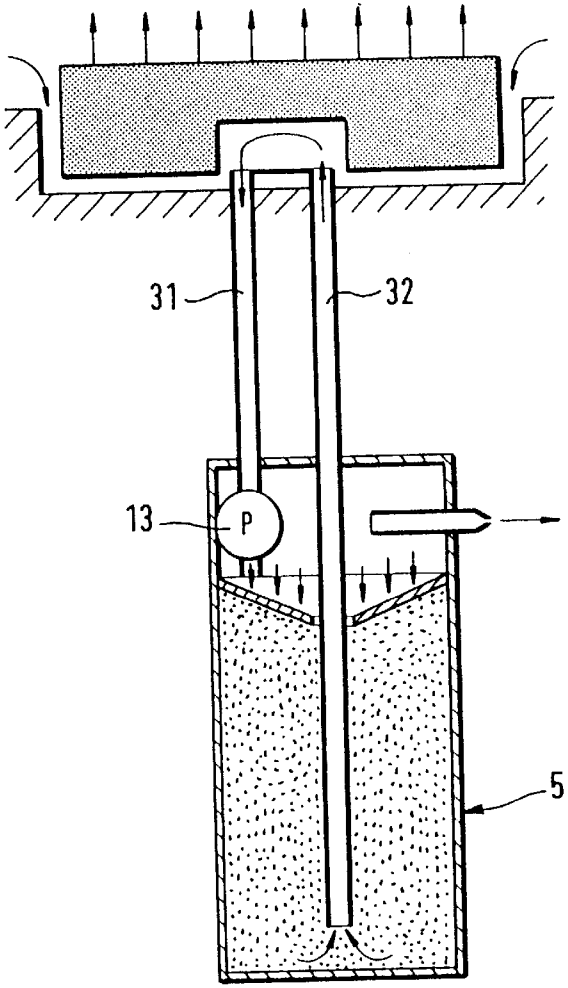
FIGS. 7 and 8 are schematic views of the liquid conveying arrangement comprised of a liquid container, a liquid dispensing device, a first and a second liquid conduit, and a pumping device.

FIG. 8 shows the liquid conveying arrangement of FIG. 7, the difference being that the pumping device 13 is disposed inside the liquid container 5, i.e., in the first chamber 40. The pumping device is part of the liquid container 5 and can be replaced together with it. The liquid container 5 can be replaced because the first liquid conduit 31 and the second liquid conduit 32 are coupled to the liquid container 5 by means of suitable coupling elements—not shown. Such coupling elements can also be provided in the first liquid conduit 31 and the second liquid conduit 32 of FIG. 7 in order to couple the pumping device 13 and the liquid container 5 to said conduits.

A suitably shaped rubber part, which tightly closes the complete unit, including the first and second liquid conduits 31, 32, is used as a cover for the liquid container 5. Metal tips of the first and second liquid conduits 31, 32, which are located inside the housing 1, pierce the cover in the area of the conduits when the cleaning liquid container is inserted, thus opening the liquid circuit.

The described configuration of the liquid container 5 is preferably implementable as a disposable cartridge or in the form of a container which can be filled in or on the hair removing apparatus.

Figure 9:
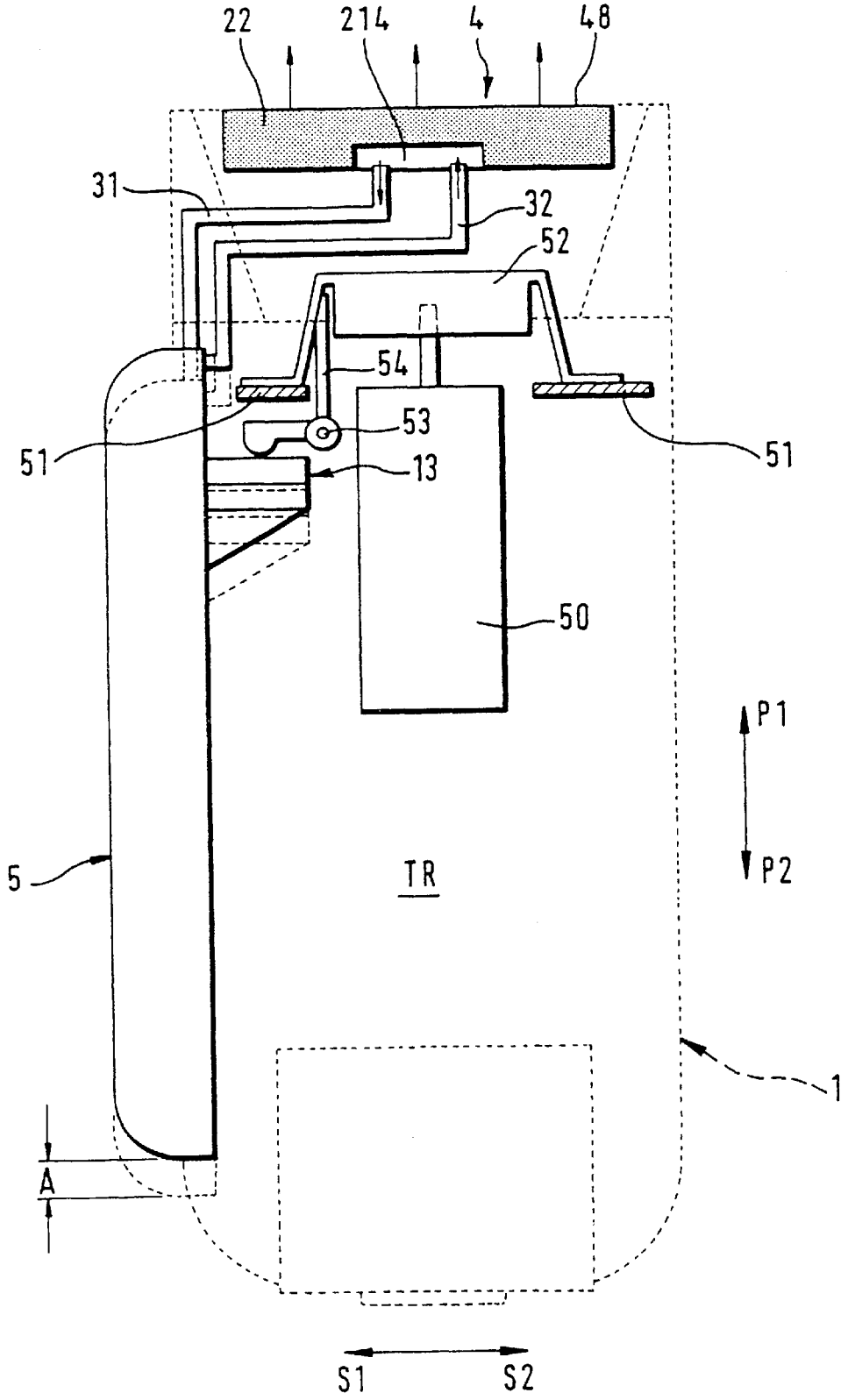
FIG. 9 is schematic view of the outer contours of a dry shaving apparatus with a drive mechanism for operating a shaving arrangement and a pumping device for feeding liquid from a liquid container into the liquid dispensing device.

FIG. 9 shows a schematic representation of the layout of a liquid conveying arrangement of FIG. 7 in a dry shaving apparatus TR of FIGS. 1 and 2. The contours of the dry shaving apparatus are represented by dotted lines by way of example.

In the housing 1 of the dry shaving apparatus TR there is arranged an electric motor 50 whose motor shaft is coupled by an eccentric to an oscillating member 52 in order to make it oscillate to and fro—see the directions of the arrows S1 and S2. The oscillating bridge 52 serves the function of driving cutter elements of the dry shaving apparatus TR—not illustrated—in addition to driving the pumping device 13 of the liquid dispensing device 4. For this purpose the oscillating member 52—which is fastened, for example, on wall elements 51 of the housing 1 of the dry shaving apparatus TR—is coupled by way of a double-armed oscillating lever 54, which is pivotally connected to a pivot 53 provided on the housing 1, to a pumping element of the pumping device 13 in order to transmit a driving motion. This driving connection is interruptible by sliding the liquid container 5 in the direction of the arrow P2 by a distance A so that no liquid is fed from the container 5 into the rinsing chamber 214 and the open-pore contact element 22. By sliding the liquid container 5 in the direction of the arrow P1 it is possible to re-establish the connection between the pumping element of the pumping device 13 and the double-armed lever 54 so that when the electric motor 50 is set in operation the oscillating movements of the oscillating member 52 are transmitted via the double-armed lever 54 to the pumping element of the pumping device 13, thus re-starting the liquid conveying arrangement.

The rinsing chamber 214 is coupled to the liquid container 5 via the pumping device 13 by means of a first liquid conduit 31—see FIG. 9—and to the first chamber 40 by means of a second liquid conduit 32. The first and second liquid conduits are of flexible construction in order to be able to follow the sliding movement of the liquid container 5 in the directions of the arrows P1 and P2.

Figure 10:
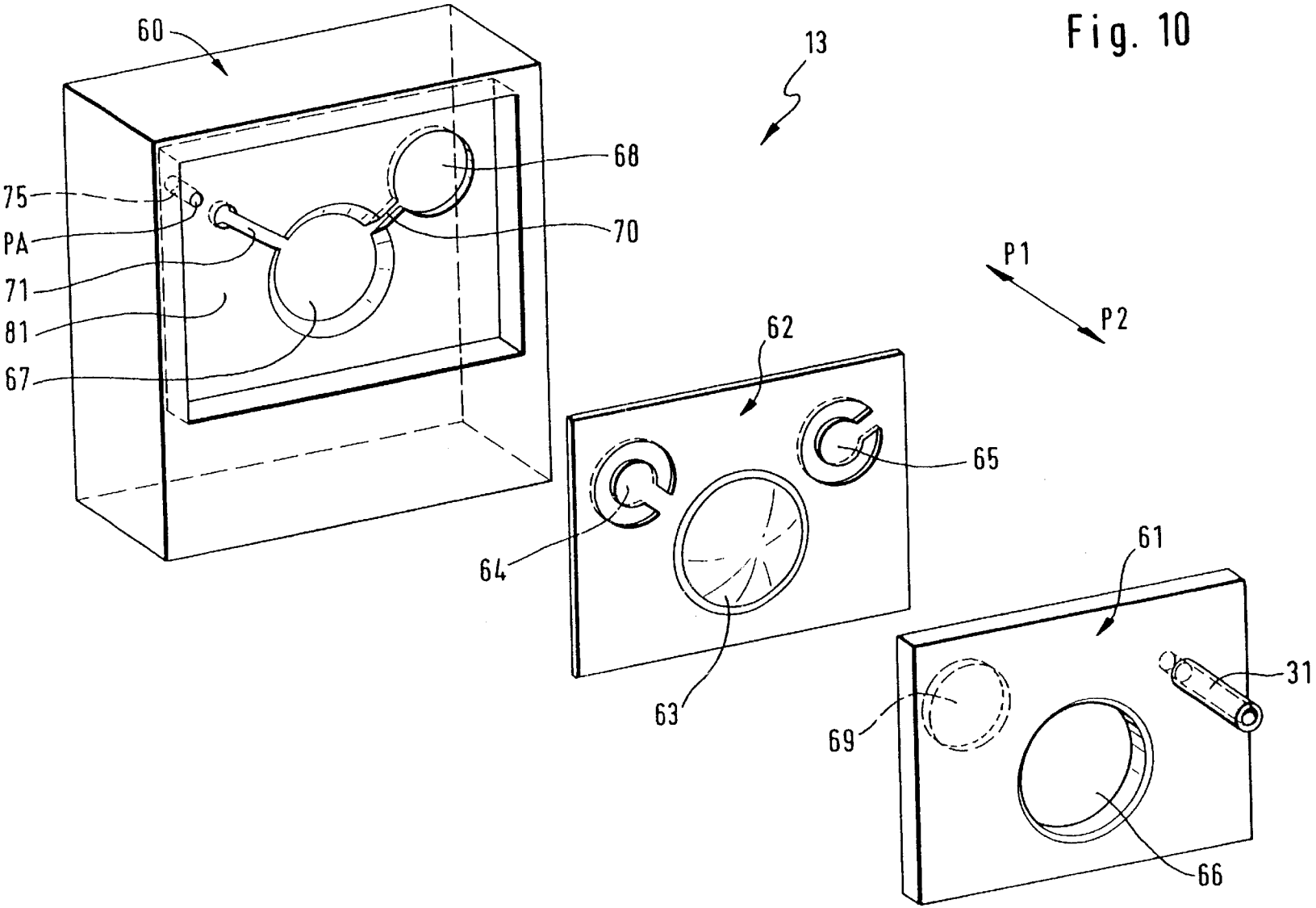
FIG. 10 is a view of a first and a second housing part and a membrane of a pumping device.

The components of a pumping device 13 are shown in FIG. 10. The pumping device 13 is comprised of only three parts, including a first housing part 60, a second housing part 61, and a membrane 62 which is disposed between the first housing part 60 and the second housing part 61. The membrane 62 has an elastic pumping element 63 projecting from the planar membrane wall in slightly domed form. Two flutter valves 64 and 65, which act as non-return valves, are provided in the wall of the membrane 62. The flutter valves 64 and 65 are elastically formed in the membrane wall and are a part of the membrane 62. The second housing part 61 is equipped with an opening 66 through which the pumping element 63 can be actuated by a drive element, e.g., by one arm of the double-armed lever 54 of FIG. 9. A first liquid conduit 31 is connectable to the second housing part 61. In the first housing part 60 is a pump chamber 67 which is connectable by way of a flow channel 70 to a first valve chamber 68 and by way of a further flow channel 71 to the second valve chamber 69 provided in the second housing part 61. The second valve chamber 69 is adapted to be coupled by way of an outlet PA and a pump outlet conduit 75 to a liquid conduit 47 leading to the first chamber 40 of the liquid container 5—see FIG. 7. The flutter valve 65 provided in the membrane 62 is associated on the one hand with the first liquid conduit 31 and on the other hand with the first valve chamber 68. The flutter valve 64 is associated with the second valve chamber 69 and with the liquid conduit 47 leading out of said chamber. Exerting a reciprocating pumping movement on the pumping element 63 causes the pumping element 63 to draw in and pump out liquid and/or air in alternation. During the pumping cycle the pumping element 63 is urged into the pump chamber 67 in the direction of the arrow P1. As this occurs, the liquid and/or air present in the pump chamber 67 is urged via the flow channel 71 against the flutter valve 64, moving the elastic flutter valve 64 into the second valve chamber 69, thereby clearing the flow path for the liquid and/or air via the second valve chamber 69 into the pump outlet conduit 75. The liquid and/or air subsequently flows via a connectable liquid conduit 47 into the first chamber 40 of the liquid container. During this pumping cycle the air and/or liquid exposed to the pumping pressure acts via the flow channel 70 and the first valve chamber 68 against the flutter valve 65, closing the pump inlet opening in the second housing part 61 which is adapted to be coupled with the first liquid conduit 31.

On termination of the pumping cycle the tensioned elastic pumping element 63 moves in the direction of the arrow P2 back to its initial position, thereby drawing in air and/or liquid from the first liquid conduit 31. This suction cycle causes the flutter valve 65 to move into the first valve chamber 68, thus clearing the liquid conduit 31 and enabling the air and/or liquid to flow via the first valve chamber and the flow channel 70 into the pump chamber 67. The flutter valve 64 is constructed and arranged relative to the flow channel 71 so that during the suction cycle the flow channel 70 is covered to such an extent that no air and/or liquid is allowed to flow past the flutter valve 64 into the second valve chamber 69 nor from there into the opening, not covered by the flutter valve 64, of the outlet PA and the pump outlet conduit 75.

The pumping device 13 represented in FIG. 10 may be arranged either outside or inside a liquid container 5, as is shown in FIGS. 7 and 8.

Figure 11:
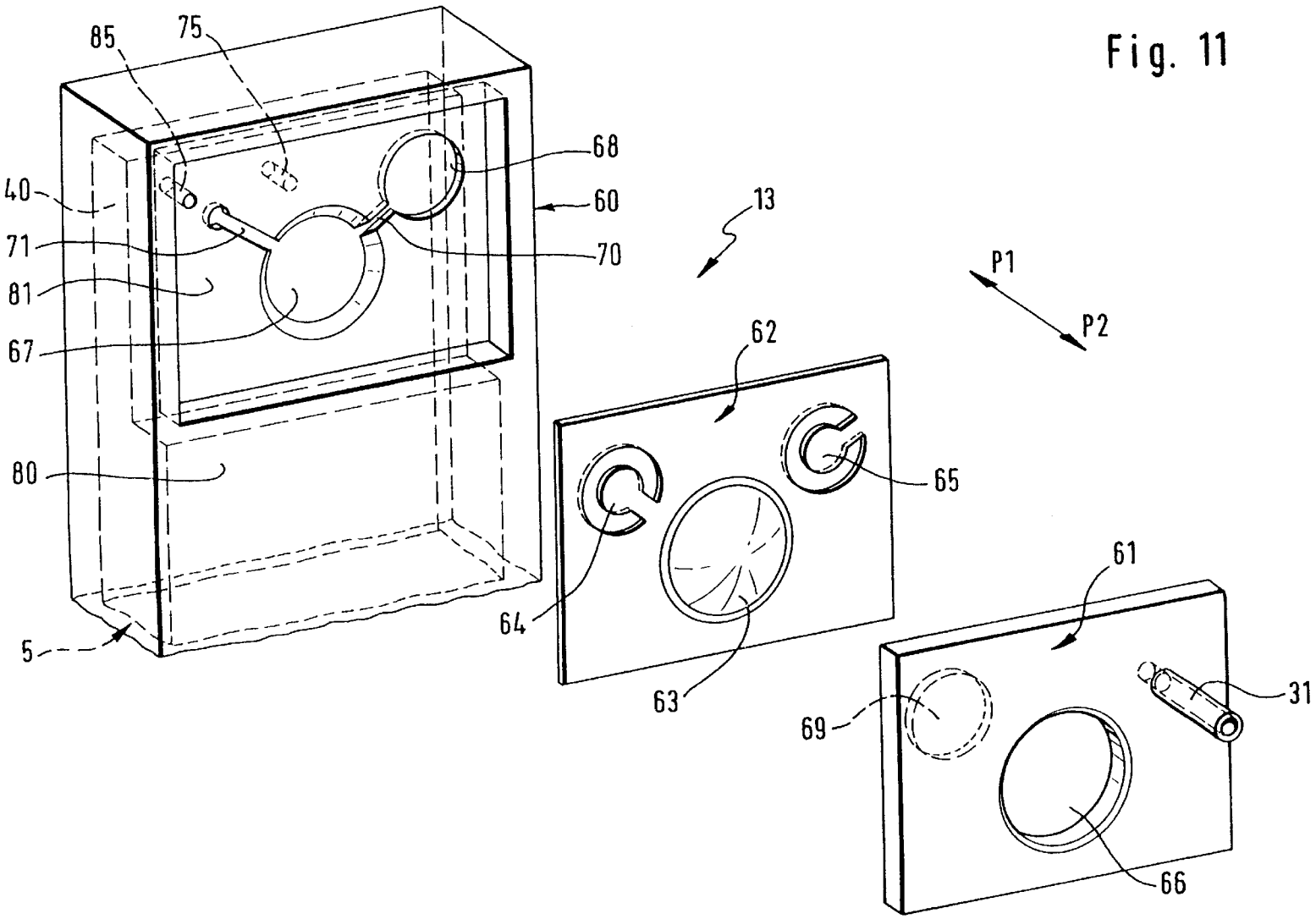
FIG. 11 is a view illustrating the integration of a pumping device into the housing of a liquid container.

According to a further embodiment the pumping device 13 may also be configured as part of the liquid container 5, as is shown in FIG. 11 by way of example.

The pumping device of FIG. 11 differs from the pumping device of FIG. 10 only inasmuch as the first housing part 60 of the pumping device 13 is part of a wall of the liquid container 5. In FIG. 11 part of the interior of a liquid container 5, namely the first chamber 40, is represented by broken lines. The chamber 40 is connectable by way of a pump outlet conduit 75 to the second liquid conduit—see FIG. 7. In the front 80 of the liquid container 5 provision is made for a depression 81 accommodating the first valve chamber 68, the flow channel 70, the pump chamber 67, the flow channel 71, and a liquid conduit 85 connecting the second valve chamber 69 to the first chamber 40 of the liquid container 5. The membrane 62 is embedded in the depression 81 and, using the second housing part 61 and suitable fastening elements, the previously listed components are assembled to form a complete pumping device 13 and then put into operation.

The liquid container 5 is inserted in the housing 1 of the hair removing apparatus and the sealing part pierced in the areas of the conduits, thus establishing a connection to the liquid conveying arrangement of the apparatus 1. Inserting the liquid container 5 simultaneously positions the pumping device 13 in front of the oscillating member 54 located in the housing 1. When the application function is activated the pumping device 13 begins to build up pressure in the liquid container 5. The air drawn in during the starting cycle is pumped into the first chamber 40 and can pass through the outlet gap 43 between the second liquid conduit 32 and the partition wall 42 into the second chamber 41 where it exerts pressure on the liquid. At the same time the suction cycle of the pumping device 13 produces a suction effect in the second liquid conduit 32 of the liquid circuit, which draws the liquid into the liquid dispensing device 4. The application point in the liquid dispensing device 4 is designed so that the pumping device 13 can draw in air from the outside at the same time as drawing in the non-applied liquid. Hence after the starting cycle the pumping device 13 invariably feeds a mixture of liquid and air into the liquid container 5, where the mixture is separated into its two components. This separation occurs on the inner wall of the first chamber 40 as the result of the adhesive force of the droplets. As the drops grow bigger they flow back through the outlet gap 43 into the second chamber 41 and so are returned to the liquid circuit.

Because this arrangement permanently draws in air in addition to the non-consumed liquid, the pressure built up in the first chamber 40 is higher than that which escapes with the liquid. This overpressure in the first chamber 40 prevents the liquid flowing back from the second chamber 41 into the first chamber 40. The pressure is stabilized by a defined opening in the air discharge throttle which acts as a pressure relief valve. Arranging the air discharge throttle in the upper area of the first partitioned chamber 40 prevents the inflowing droplets being blown out unintentionally when the hair removing apparatus is in an inclined position. Operation of the arrangement is thus guaranteed even with the hair removing apparatus turned through 180° compared to the position illustrated in FIG. 1.

The porous storage material ensures operational reliability also in cases when the liquid container 5 is not full. In this case the liquid reaches the suction zone of the second liquid conduit 32 through the capillary action of the storage material. Liquid movements and attendant noise are also minimized.

On account of the described structural design it is possible to store and dispense liquids independently of position and movement, with the arrangement simultaneously providing for regulation of the quantity of liquid to be dispensed.

What is claimed is:

1. A hair removing apparatus comprising a housing and a liquid conveying arrangement, the liquid conveying arrangement comprising a liquid container arranged in or on the housing, a drivable pumping device with a pump inlet and a pump outlet, and a liquid dispensing device for wetting a human skin and hairs with a liquid, wherein the liquid dispensing device is coupled to the pump inlet by way of a first liquid conduit and to the liquid container by way of a second liquid conduit.

2. The hair removing apparatus of claim 1, wherein the second liquid conduit is arranged so that during operation the pumping device draws both air and liquid from the liquid dispensing device and conveys it into the liquid container, and wherein the liquid container is constructed so that during operation the air and liquid conveyed to it by the pumping device creates a delivery pressure within the container that delivers the liquid from the container to the liquid dispensing device.

3. The hair removing apparatus of claim 1, wherein a pressure relief valve is provided in the liquid container.

4. The hair removing apparatus of claim 1, wherein the liquid container includes first and second chambers.

5. The hair removing apparatus of claim 4, wherein the first chamber is provided for receiving at least one of air and liquid returnable from the liquid dispensing device.

6. The hair removing apparatus of claim 4, wherein the second chamber accommodates a storage material for holding the liquid.

7. The hair removing apparatus of claim 4, wherein at least one passageway provided in a partition wall separating the first chamber from the second chamber for a return flow of the liquid from the first chamber to the second chamber.

8. The hair removing apparatus of claim 7, wherein the passageway is of a slotted configuration.

9. The hair removing apparatus of claim 8, wherein a liquid conduit is routed through the passageway and a gap is formed between the second liquid conduit and the partition wall.

10. The hair removing apparatus of claim 9, wherein the second chamber is adapted to be coupled with the liquid dispensing device through the second liquid conduit.

11. The hair removing apparatus of claim 8, wherein the second liquid conduit is configured to project into the second chamber such an amount that a mouth of the second liquid conduit is arranged at a relatively small distance to a wall of the liquid container.

12. The hair removing apparatus of claim 9, wherein the second liquid conduit is constructed as a riser.

13. The hair removing apparatus of claim 12, wherein the pumping device is provided in the first liquid conduit, the first liquid conduit leading from the liquid dispensing device to the liquid container.

14. The hair removing apparatus of claim 12, wherein the pumping device is arranged in the liquid container.

15. The hair removing apparatus of claim 12, wherein a pumping element of the pumping device is adapted to be acted upon by a drive element of a drive mechanism of the hair removing apparatus.

16. The hair removing apparatus of claim 12, wherein a pumping element of the pumping device is manually actuatable.

17. The hair removing apparatus of claim 1, wherein the liquid dispensing device is formed of a container housing having one side open and a contact element partly protruding therefrom and adapted to dispense liquid.

18. The hair removing apparatus of claim 15, wherein the contact element is formed of an open-pore material.

19. The hair removing apparatus of claim 18, wherein a rinsing chamber is provided in the liquid dispensing device.

20. The hair removing apparatus of claim 1, wherein the liquid dispensing device is provided on a long hair cutter unit.

21. The hair removing apparatus of claim 1, wherein the liquid dispensing device is provided on a removable frame.

22. The hair removing apparatus of claim 21, wherein the removable frame is constructed as a shaving head frame.

23. The hair removing apparatus of claim 21, wherein the removable frame is constructed as a cutter frame.

24. The hair removing apparatus of claim 1, wherein the liquid container is arranged for replacement in or on the hair removing apparatus.

25. The hair removing apparatus of claim 1, wherein the liquid container is adjustable from a distance.

26. The hair removing apparatus of claim 1, wherein the liquid container is equipped with a filling valve.

27. The hair removing apparatus of claim 1, wherein the liquid container and pumping device are arranged to be adjustable from a distance.

28. The hair removing of claim 1, wherein the liquid container with the pumping device is adapted to be coupled to the electric motor.

29. The hair removing apparatus of claim 28, wherein the pumping device is adapted to be coupled to the electric motor via oscillating members.

30. A hair removing apparatus comprising a housing and a liquid conveying arrangement, the liquid conveying arrangement comprising a liquid container, a drivable pumping device with a pump inlet and a pump outlet, and a liquid dispensing device for wetting a human skin and hairs with a liquid, wherein the liquid dispensing device is coupled to the pump inlet by way of a first liquid conduit and to the liquid container by way of a second liquid conduit, and wherein the liquid container includes a first chamber and a second chamber.

31. The hair removing apparatus of claim 30, wherein the first chamber is provided for receiving at least one of air and liquid returnable from the liquid dispensing device.

32. The hair removing apparatus of claim 30, wherein the second chamber accommodates a storage material for holding the liquid.

33. The hair removing apparatus of claim 30, wherein at least one passageway is provided in a partition wall separating the first chamber from the second chamber for a return flow of the liquid from the first chamber to the second chamber.

34. The hair removing apparatus of claim 33, wherein the passageway is of a slotted configuration.

35. The hair removing apparatus of claim 34, wherein a liquid conduit is routed through the passageway and a gap is formed between the second liquid conduit and the partition wall.

36. The hair removing apparatus of claim 35, wherein the second chamber is adapted to be coupled with the liquid dispensing device through the second liquid conduit.

37. The hair removing apparatus of claim 34, wherein the second liquid conduit is configured to project into the second chamber such an amount that a mouth of the second liquid conduit is arranged at a relatively small distance to a wall of the liquid container.

38. The hair removing apparatus of claim 35, wherein the second liquid conduit is constructed as a riser.

39. The hair removing apparatus of claim 38, wherein the pumping device is provided in the first liquid conduit, the first liquid conduit leading from the liquid dispensing device to the liquid container.

40. The hair removing apparatus of claim 38, wherein the pumping device is arranged in the liquid container.

41. The hair removing apparatus of claim 38, wherein a pumping element of the pumping device is adapted to be acted upon by a drive element of a drive mechanism of the hair removing apparatus.

42. The hair removing apparatus of claim 38, wherein a pumping element of the pumping device is manually actuatable.

* * * * *